US009890549B2

(12) United States Patent
Gambarotta et al.

(10) Patent No.: US 9,890,549 B2
(45) Date of Patent: Feb. 13, 2018

(54) STORAGE SYSTEM

(71) Applicant: Kairos Industrial AG, Freienbach (CH)

(72) Inventors: Riccardo Gambarotta, Zürich (CH); Alessandro Gambarotta, Zürich (CH)

(73) Assignee: KAIROS INDUSTRIAL AG, Freienbach (CH)

( * ) Notice: Subject to any disclaimer, the term of this patent is extended or adjusted under 35 U.S.C. 154(b) by 0 days.

(21) Appl. No.: 15/134,564

(22) Filed: Apr. 21, 2016

(65) Prior Publication Data

US 2016/0312487 A1 Oct. 27, 2016

(30) Foreign Application Priority Data

Apr. 21, 2015 (EP) ..... 15164507

(51) Int. Cl.

| | |
|---|---|
| ***E04H 6/12*** | (2006.01) |
| ***B65D 85/68*** | (2006.01) |
| ***B65D 88/54*** | (2006.01) |
| ***B65D 90/00*** | (2006.01) |
| ***E04H 6/00*** | (2006.01) |

(52) U.S. Cl.

CPC ..... *E04H 6/12* (2013.01); *B65D 85/68* (2013.01); *B65D 88/546* (2013.01); *B65D 90/008* (2013.01); *E04H 6/005* (2013.01); *B65D 2585/6862* (2013.01); *B65D 2585/6865* (2013.01)

(58) Field of Classification Search

CPC ... E04H 6/005; E04H 6/12; B65D 2585/6862; B65D 2585/6865; B62H 3/00

See application file for complete search history.

(56) References Cited

U.S. PATENT DOCUMENTS

| | | | | |
|---|---|---|---|---|
| 4,156,994 | A * | 6/1979 | Steuer | E04H 6/005 312/202 |
| 5,845,788 | A | 12/1998 | Robolin | |
| 6,345,948 | B1 | 2/2002 | Irish | |
| 9,073,591 | B2 * | 7/2015 | Lee | B62H 3/00 |
| 2010/0204823 | A1 | 8/2010 | North | |

FOREIGN PATENT DOCUMENTS

| | | | | |
|---|---|---|---|---|
| DE | 9319662 | U1 * | 2/1994 | B65H 3/12 |
| DE | 9410464 | U1 * | 9/1994 | B62H 3/00 |
| DE | 9418015 | U1 * | 2/1995 | B62H 3/00 |
| DE | 9420039 | U1 * | 2/1995 | B62H 3/00 |
| DE | 19500094 | A1 * | 7/1996 | E04H 6/005 |
| DE | 19542680 | A1 * | 5/1997 | B62H 3/00 |
| DE | 202013009311 | U1 | 11/2013 | |

(Continued)

*Primary Examiner* — Kaitlin Joerger

(74) *Attorney, Agent, or Firm* — Browdy and Neimark, PLLC

(57) ABSTRACT

Storage system for vehicles, in particular two-wheeled vehicles, bicycles or motorcycles, having a substantially closed housing with a storage region which is not accessible from the outside and with at least one closable loading and unloading station (2) of the vehicles, a transportation system (3, 4, 5) for conveying the vehicles from the at least one loading and unloading station (2) into the storage region and within the storage region, wherein the vehicles can be stored and conveyed in mutually separate containers (9).

13 Claims, 6 Drawing Sheets

(56) References Cited

FOREIGN PATENT DOCUMENTS

| | | | | | |
|---|---|---|---|---|---|
| DE | 202016101921 | U1 | * | 6/2016 | ..... B62H 3/08 |
| EP | 0677628 | A1 | * | 10/1995 | ..... E04H 6/005 |
| EP | 1031679 | A1 | | 8/2000 | |
| WO | WO 9617148 | A1 | * | 6/1996 | ..... A63C 11/00 |
| WO | 2007029026 | A1 | | 3/2007 | |
| WO | WO 2009019904 | A1 | * | 2/2009 | ..... E04H 6/005 |
| WO | WO 2010150834 | A1 | * | 12/2010 | ..... B62H 3/00 |
| WO | 2014017919 | A1 | | 1/2014 | |

* cited by examiner

STORAGE SYSTEM

TECHNICAL FIELD

The present invention relates to a storage system for vehicles, in particular for two-wheeled vehicles, bicycles or motorcycles.

PRIOR ART

In the case of conventional storage systems for vehicles, in particular for two-wheeled vehicles, bicycles or motorcycles, vehicles are stored individually or jointly in a storage region.

WO 2007/029026 presents a storage box for a motor cycle, wherein there is sufficient space available in the box to stow a motorcycle and the associated equipment, such as helmet and protective clothing, therein. The box has an access system which permits access to an authorized person. If multiple motorcycles are to be stowed, it is necessary for multiple such boxes to be arranged adjacent to one another. This requires a large amount of space and a large amount of installation and maintenance outlay, because the boxes are independent of one another and each must be supplied with electricity, and each has a dedicated access system.

US 2010/0204823 presents an automated bicycle storage system in which a bicycle can, at a loading and unloading station, be suspended by way of the front wheel on a hook provided for the purpose. A robot arm transfers the bicycle, suspended on the hook, to a transportation system which is situated in a storage region and which serves simultaneously for transportation and for storage. A storage system of said type permits only the storage of bicycles without accessories.

U.S. Pat. No. 5,845,788 presents a bicycle storage system in which multiple bicycles can be arranged adjacent to one another on a common bar. The arrangement is performed by way of special suspension devices which can be fastened to the respective handlebar and saddle. Multiple bars are connected to one another by way of common, closed-loop transportation chains. In the case of a storage system of said type, the supply of the bicycle is cumbersome, and the arrangement of the bicycles makes it possible for a user to have access to all bicycles.

PRESENTATION OF THE INVENTION

It is therefore an object of the invention to provide a storage system for vehicles, in particular for two-wheeled vehicles, bicycles or motorcycles, which storage system avoids the disadvantages known from the prior art.

Said object is achieved by way of a storage system having the features of claim 1.

A storage system according to the invention for vehicles, in particular two-wheeled vehicles, bicycles or motorcycles, has a substantially closed housing with a storage region which is not accessible from the outside and with at least one closable loading and unloading station of the vehicles, a transportation system for conveying the vehicles from the at least one loading and unloading station into the storage region and within the storage region, wherein the vehicles can be stored and conveyed in mutually separate containers. This has the advantage that, for example, a bicycle can be simply pushed into the container at the loading and unloading station. Thereafter, only an authorized user has access to the respective vehicle, and it is possible for not only the vehicle but also further articles, such as for example baggage, clothing, helmets or electrical accumulators, such as batteries or the like, to be accommodated and securely stored in the container.

It is preferable for each of the containers to be of substantially cuboidal shape and to be at least partially closed at least by a base and by side walls on three sides. For example, a rear wall and the two side walls laterally adjoining said rear wall are substantially closed. Alternatively, a front wall situated opposite the rear wall may be provided instead of one side wall. In both cases, this makes it possible for a vehicle to be easily pushed in from the front or from the side.

In a preferred embodiment, each container additionally has a closable door by way of which a further side is at least partially closable, and/or has a lid by way of which a top side is at least partially closable. The closable door may be formed instead of the front wall or instead of a side wall. A closable door or a closable lid are conducive to achieving that the interior of the container is better protected against external influences.

The door and the lid are preferably operatively connected and movable jointly with one another. For example, the opening of the lid may have the effect that the door is simultaneously opened, and during the closing of the lid, the door closes simultaneously. This simplifies the operating process. Furthermore, it is possible for assistance elements, such as for example spring elements or counterweights, to be arranged in or on the container, which assistance elements assist the opening and closing of door and/or lid, which makes the operating process more comfortable, because less force has to be expended.

It is preferably the case that each container can be at least partially deployed out of the housing at the at least one loading and unloading station. This allows the loading and unloading station to be arranged at any desired point of the housing. If the loading and unloading station is arranged at a lateral edge of the housing, lateral loading and unloading of the container is possible even without the container being deployed out of the housing.

In a preferred embodiment, the transportation system is designed such that the containers can be conveyed in a horizontal or vertical direction. This permits flexible storage of the vehicles, which can be adapted to the local installation conditions.

The transportation system is preferably divided into units which are responsible for the horizontal conveyance of the containers and units which are responsible for the vertical conveyance of the containers, wherein the containers are movable independently of one another or jointly with—one another. This permits a modular construction of the storage system, which is conducive to optimum utilization of the available space. For example, in the case of a limited floor area, it is thus possible for multiple horizontal transportation units to be arranged one above the other, which horizontal transportation units may be combined with one or more vertical transportation units, or, in the case of a limited height, multiple vertical transportation units may be arranged adjacent to one another, which vertical transportation units may be combined with one or more horizontal transportation units. It is also possible for multiple horizontal or vertical transportation units to be combined, and to thus in turn form horizontal or vertical transportation units. The individual transportation units may have dedicated drives, or may have a common drive. This applies to horizontal and vertical transportation units respectively in themselves, or to the combination of horizontal and vertical transportation units.

In a preferred embodiment, the units for the vertical conveyance of the containers are arranged laterally in each case on an opposite side of the units for the horizontal conveyance of the containers, or the units for the horizontal conveyance of the containers are arranged in each case above or below on an opposite side of the units for the vertical conveyance of the containers. This arrangement of the transportation units allows the containers to be conveyed in a type of circuit, that is to say the individual transportation units are coordinated with one another such that the same number of containers is conveyed simultaneously from one unit into a subsequent unit in the conveying direction. This leads to uniform loading of the storage system.

It is preferable for at least a multiplicity of the containers to be connected by way of the transportation system, and for at least the multiplicity of the containers to be movable simultaneously with one another. This has the advantage that it is not necessary for a multiplicity of drive systems to be coordinated with one another, which leads to a simplification of the overall system.

In a preferred embodiment, the storage system has a charging system, by way of which electrical energy can be supplied to each container. This makes it possible for each container to have a dedicated electrical supply. This makes it possible for each container to have at least one inwardly oriented electrical terminal to which an electrical device can be connected by a user. It is possible for multiple different electrical terminals to be provided, such as for example locally conventional plug sockets for electrical current, USB ports or other connectors that are suitable for the transmission of electrical energy.

The electrical terminals are preferably designed such that an electrical accumulator for a vehicle with an electric drive, or a vehicle with an electric drive, can be connected to the inwardly oriented electrical terminal. The electrical terminals may, as described above, be in the form of plug sockets, though they may alternatively or additionally have an extension cable, to the free end of which an electrical device can be connected. This increases the convenience for the user, because he or she can for example connect the cable terminal to an electric bicycle, or can alternatively connect the battery of an electric vehicle separately and deposit this in the container. It is likewise possible for an electrical adapter for a user's own charging device to be connected to a plug socket connector. Through the selection of the different connection possibilities, a flexible and user-friendly storage and charging system is made available.

The storage system preferably also has an input unit which allows a user access to the system, a control unit for controlling and monitoring the system and for optional data communication with an external control unit, wherein the control unit can be actuated by the input unit, and wherein the control unit is responsible in particular for access authorization for the user and for the conveyance of the vehicles. At the input unit, it is for example possible for a user to input his or her authorization, to make a payment or to request assistance. For payment, use may be made of known payment methods such as for example credit cards, smartphones, vouchers or cash. The storage system must then be equipped with the corresponding apparatus for recording of payments.

In a preferred embodiment, the storage system has at least one securing element by way of which the system can be secured in a usage space, such that unauthorized removal of the storage system can be prevented. This is advantageous in particular in the case of relatively small storage systems that are transportable, for example, by way of a lightweight truck, in order that said storage systems cannot be simply loaded thereon.

Further embodiments are specified in the dependent claims.

BRIEF DESCRIPTION OF THE DRAWINGS

Preferred embodiments of the invention will be described below on the basis of the drawings, which serve merely for explanation and are not to be interpreted as being restrictive. In the drawings.

DESCRIPTION OF PREFERRED EMBODIMENTS

Figure 1:
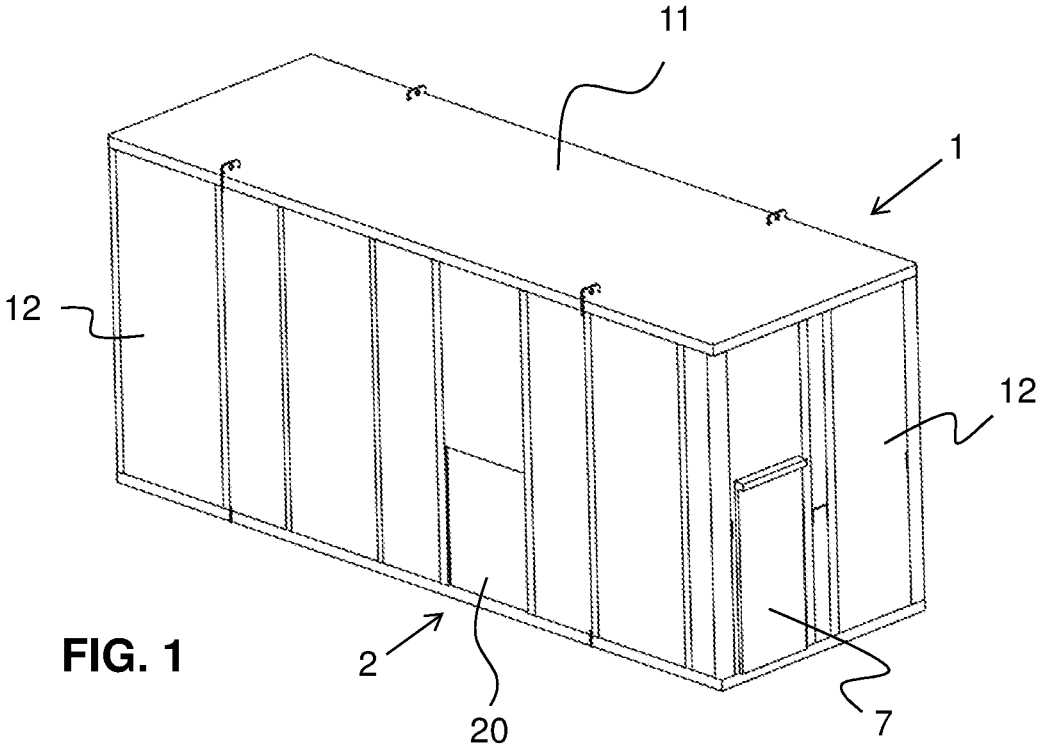
FIG. 1 shows a perspective view of a storage system according to the invention.

FIG. 1 shows a perspective view of a storage system according to the invention, having a closed housing 1, having a loading and unloading station 2 which can be closed by way of a hatch 20, and having an input unit 7 which is arranged, so as to be accessible from the outside, on the housing 1.

Figure 2:
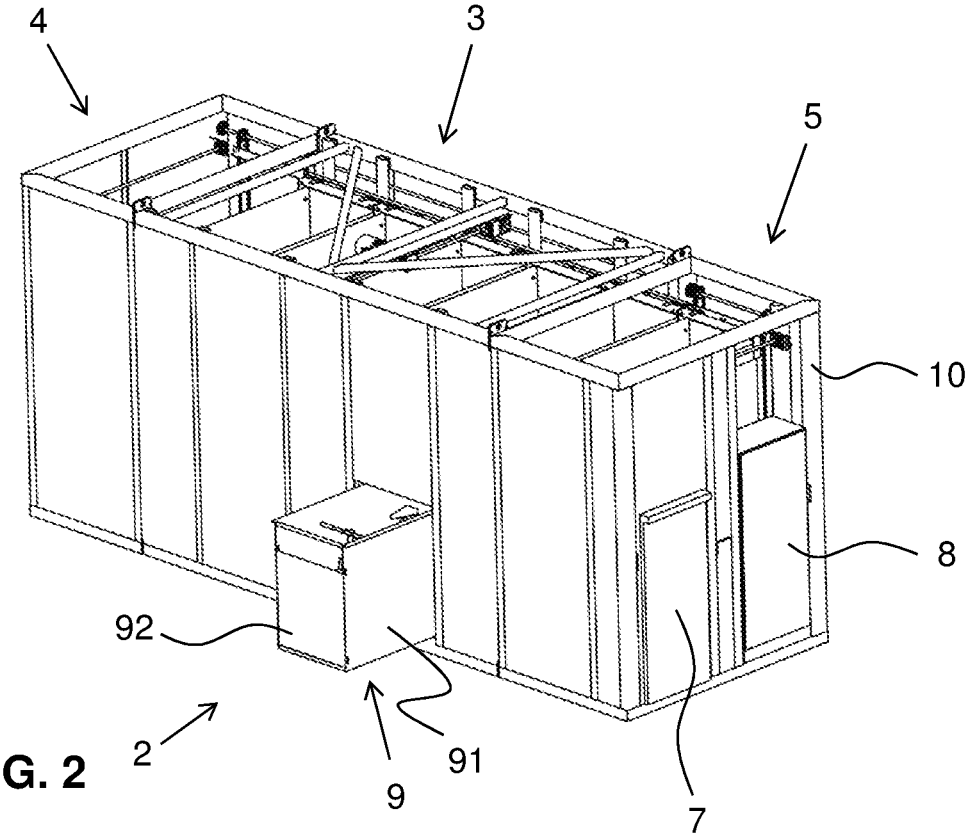
FIG. 2 shows a perspective view of the storage system of FIG. 1, without an upper cover element and with a deployed container.

FIG. 2 shows a perspective view of the storage system of FIG. 1, without an upper cover element 11 and with a deployed container 9. A lateral cover element of the housing 1 has likewise been removed in this view, such that a control unit 8 situated behind it is visible. To be able to deploy the container 9 at the loading and unloading station 2, the hatch 20 must first be opened. This is performed by way of a conventional sliding hatch drive.

A deploying system arranged at the loading and unloading station 2 ensures reliable and stable retraction and deployment of the container 9 into and out of the housing 1.

The container 9 that is shown has a base 90, a rear wall 94, and two side walls 91 which laterally adjoin the rear wall 94, which side walls are at least partially closed. On that side of the container 9 which is situated opposite the rear wall 94 there is arranged a door 92, which constitutes a further closable side wall of the container 9. In this illustration, the container does not have a lid.

Owing to the omission of the upper cover element 11, the internal structure of the housing 1 is partially visible. Said structure is a frame construction 10 which is closed off to the outside by way of upper 11 and lateral 12 cover elements.

Some lateral cover elements 12 can be removed from the outside by maintenance personnel using special tools, thus facilitating access to the control unit 8 for maintenance purposes.

The housing 1 has substantially three regions: a central region, in which the horizontal transportation and storage unit 3 is situated, and two regions arranged to the side thereof, in which there is situated in each case one vertical transportation and storage unit 4, 5. In comparison to the first vertical transportation unit 4, the second transportation unit 5 is of larger form in order that it can additionally accommodate the input unit 7 and the control unit 8 therein.

Figure 3:
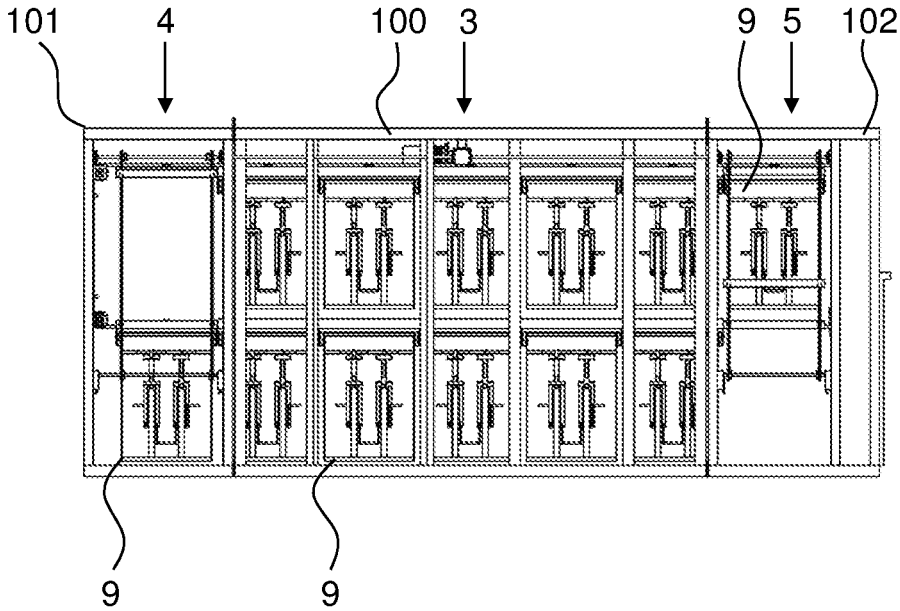
FIG. 3 shows a front view of the storage system of FIG. 1, without front cover elements.

FIG. 3 shows a front view of the storage system of FIG. 1, without front cover elements. The horizontal transportation unit 3 has a horizontal framework 100 in the form of a frame construction. The same applies to the vertical frameworks 101 and 102 of the first and second vertical transportation units 4 and 5 respectively. In the embodiment illustrated, the horizontal transportation unit 3 provides space, in each case in an upper and a lower region, for five containers 9 arranged adjacent to one another. Each of the available spaces is occupied by a container 9. Each of the vertical transportation units 4, 5 provides space for two containers 9 arranged one above the other. However, in each case only one space is occupied by a container 9, because the respective free space is required for the transfer of the containers 9 between the respective horizontal and vertical transportation units.

The modular construction of the system makes it possible for horizontal and vertical transportation units to be combined with one another as desired. As an alternative to the two rows of containers 9 arranged one above the other as illustrated in FIG. 3, it is possible for three, four, five, six or more such rows to be arranged one above the other. It is for example also possible for an even greater number of horizontal and vertical transportation units to be added to the units illustrated in FIG. 3.

The illustrated container 9 provides space for two bicycles parked adjacent to one another. There is still sufficient space in addition to this for the stowage of equipment and/or luggage.

Figure 4:
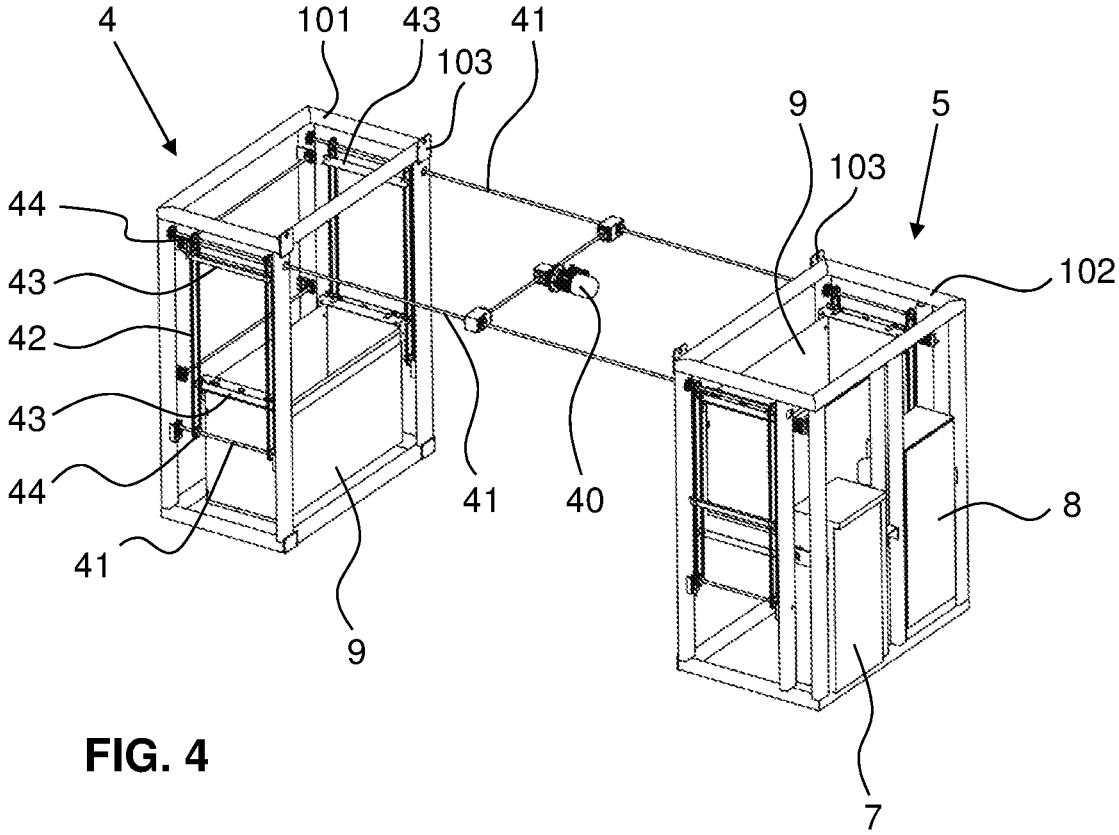
FIG. 4 shows a perspective view of the vertical transportation units of the storage system.

FIG. 4 shows a perspective view of the vertical transportation units 4, 5 of the storage system of FIG. 1. The first vertical transportation unit 4 has a framework 101 in which a container 9 and transportation means are provided, which transportation means make it possible for the container 9 to be moved from a lowered position into an upper position and vice versa. The framework 101 is a frame construction with metallic profiles which are connected to one another. On the framework 101 of the vertical transportation units 4, 5 there are provided connecting elements 103 for the connection to the horizontal transportation unit 3, which has corresponding connecting elements 104.

The illustrated transportation means is a belt drive, in the case of which belt pulleys 44 are arranged on drive shafts 41, and the belt pulleys 44 of two parallel drive shafts 41 are connected to one another by way of belts 42. In each case two belt pulleys 44 are arranged adjacent to one another, and spaced apart from one another, on a common drive shaft 41. On the belts 42 there are arranged rails 43, into/onto which a container 9 can be slid laterally. In each case two such belt drives are arranged in a vertical transportation unit, such that the container is supported on the rails 43 on two opposite sides (front and rear).

The second vertical transportation unit 5 is of substantially identical construction to the first. The framework 102 is however designed to be slightly broader such that, aside from the belt drives, there is still sufficient space available in the framework for an input unit 7 and for a control unit 8.

In the embodiment illustrated, the first and the second vertical transportation units are driven by a common, centrally arranged electromechanical drive 40. From the drive 40, the drive torque is transmitted by way of drive shafts 41 to the belt drives of the first and second transportation units 4, 5.

It is alternatively possible for sprockets and chains to be used instead of the belt pulleys and belts. It is also possible for each vertical transportation unit to have a dedicated drive. In this case, the drives must however be coordinated with one another in order that the movement of the transportation units is synchronized with one another. The vertical movement may however also be realized by way of pneumatic, hydraulic or electrical cylinders. It is important that the movements of the individual elements be coordinated with one another such that the rails 43 move parallel to and synchronously with one another, in order that the containers 9 are moved synchronously with one another and parallel to one another.

Figure 5:
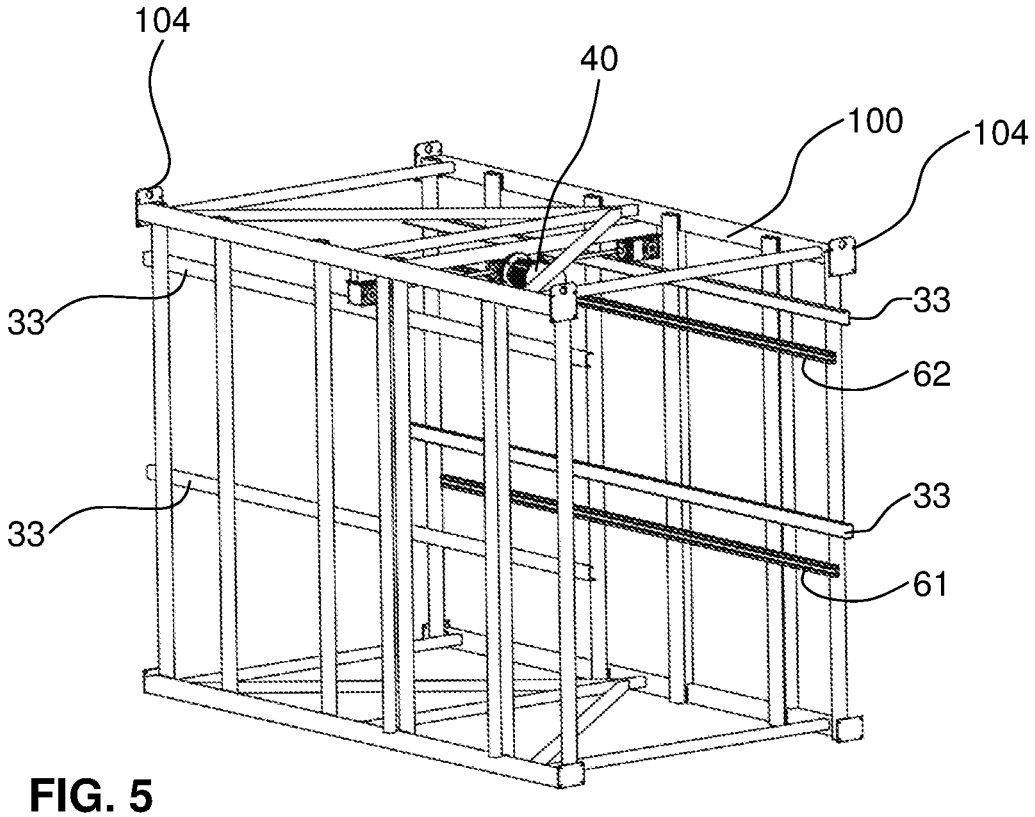
FIG. 5 shows a perspective view of the framework of the horizontal transportation unit of the storage system.

FIG. 5 shows a perspective view of the framework 100 of the horizontal transportation unit 3 of the storage system of FIG. 1. The framework 100 is a frame construction with metallic profiles which are connected to one another. On the framework 101 of the horizontal transportation unit 3 there are provided connecting elements 104 for the connection to the vertical transportation units 4, 5, which have corresponding connecting elements 103. On the front side and rear side, that is to say on the side of the loading and unloading station 2 and on the side opposite the latter, rails 33 are arranged on the framework 100, which rails are directed toward the interior of the framework 100. The rails 33 are designed such that corresponding guide rollers 972, 973, which are arranged on the container 9, can be received and guided therein. On the rear side of the framework 100 there are arranged current rails 61, 62 which are parallel to the rails 33. Each rail 33 is assigned a current rail which is arranged below, and spaced apart from, the respective rail 33. The current rails 61, 62 are designed so as to form a sliding connection with corresponding current collectors 63 which are arranged on the containers 9.

Figure 6:
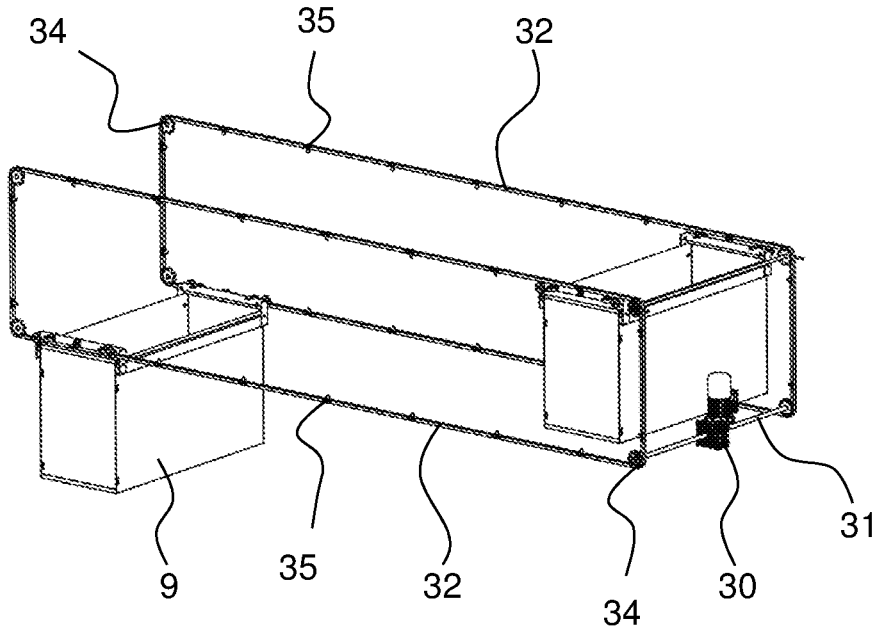
FIG. 6 shows a perspective view of the drive system of the horizontal transportation unit of the storage system.

FIG. 6 shows a perspective view of the drive system of the horizontal transportation unit 3 of the storage system of FIG. 1. The system has two parallel belt drives which are driven by a common drive 30. The drive torque is transmitted by way of a drive shaft 31 to each of the belt drives. Owing to the mechanical coupling, the two drives run synchronously, and the container 9 is driven along by drivers 35 which are arranged on each belt 32.

The belt pulleys are arranged in the respective framework 101, 102 of the vertical transportation units 4, 5, which makes it possible for the container 9 to be transferred from the horizontal transportation unit 3 into a vertical transportation unit, or to be taken from said vertical transportation unit. A chain drive may be used as an alternative to the belt drive.

On the framework 100 of the horizontal transportation unit 3 there are provided rails 33, on or in which the containers 9 are guided. By way of the belt drive with the drivers 35, it is possible for a container 9 to be conveyed from the rails 33 of the horizontal transportation unit 3 to the rails 43 of a vertical transportation unit, or vice versa.

Figure 7:
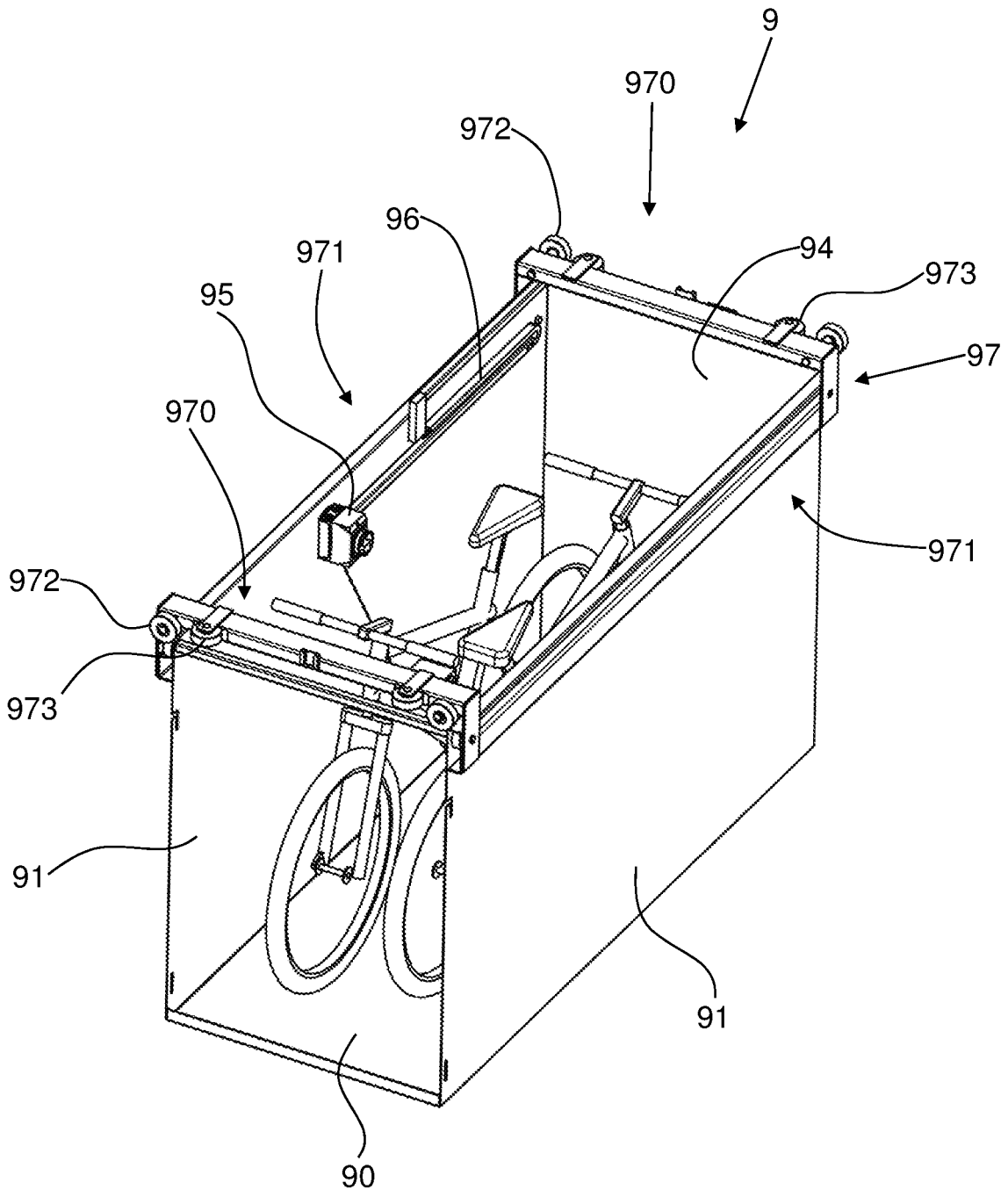
FIG. 7 shows a perspective view of a container of the storage system from the front.

FIG. 7 shows a perspective view of a container 9 of the storage system from the front. As described in conjunction with FIG. 2, the container 9 has a base 90, a rear wall 94, and two side walls 91 which laterally adjoin the rear wall 94 and which are at least partially closed. A closable door has not been illustrated in this figure in order to make the interior more clearly visible. The container 9 has a frame 97 in its upper region. The frame 97 has first and second frame elements 970, 971, which together form a substantially closed frame.

The first frame elements 970 are arranged at the front and at the rear on the container 9, and have first and second guide rollers 972, 973, which can be guided in the rails 33 of the horizontal transportation unit 3 and the rails 43 of the vertical transportation units 4, 5, wherein the first guide rollers 972 lie on top of the rails, and the second guide rollers 973 bear laterally against the rails. The second frame elements 971 connect the first frame elements 970 to one another.

The second frame elements 971 have guide rails and guide rollers, and enable a container body which has the base 90, the side walls 91 and the rear wall 94 to move relative to the frame 97. The container body can thus be pulled out in the manner of a drawer. On the side of the rear wall 94 there is provided, on the frame 97, a stop which prevents the container body, in the rear region, from being able to move out beyond the frame 97.

A drive which can effect the relative movement between the frame 97 and the container body is optional, and is not illustrated in FIG. 7. Alternatively, in the region of the loading and unloading station 2, there is arranged a drive which can effect the relative movement when a container is situated in the position of the loading and unloading station 2.

In the interior of the container 9 there is provided an electrical terminal 95. The terminal 95 may have a plug socket which allows common plugs to be connected. Alternatively or in addition, the terminal 95 may have a cable which is designed such that it can be guided within the container 9 and likewise permits the connection to common plugs or electrical accumulators or electric vehicles. To accommodate the relative movement between container body and frame 97, a flexible connection 96, in this case in the form of a cable carrier, is provided between the electrical terminal on the frame and the terminal 95 in the container interior.

Figure 8:
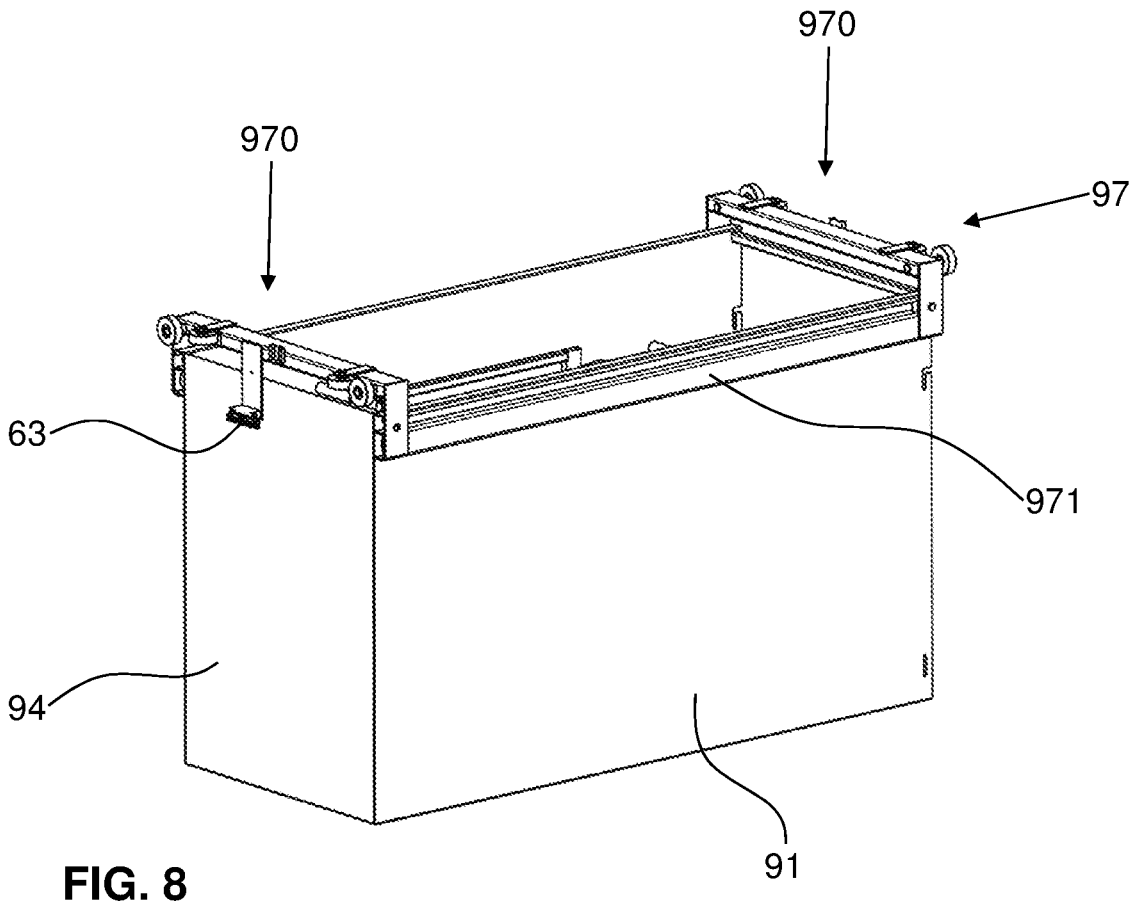
FIG. 8 shows a perspective view of a container of the storage system from the rear.

FIG. 8 shows a perspective view of a container 9 of the storage system from the rear. The current collector 63 is arranged in the region of the rear wall 94 on the first frame element 970.

Figure 9:
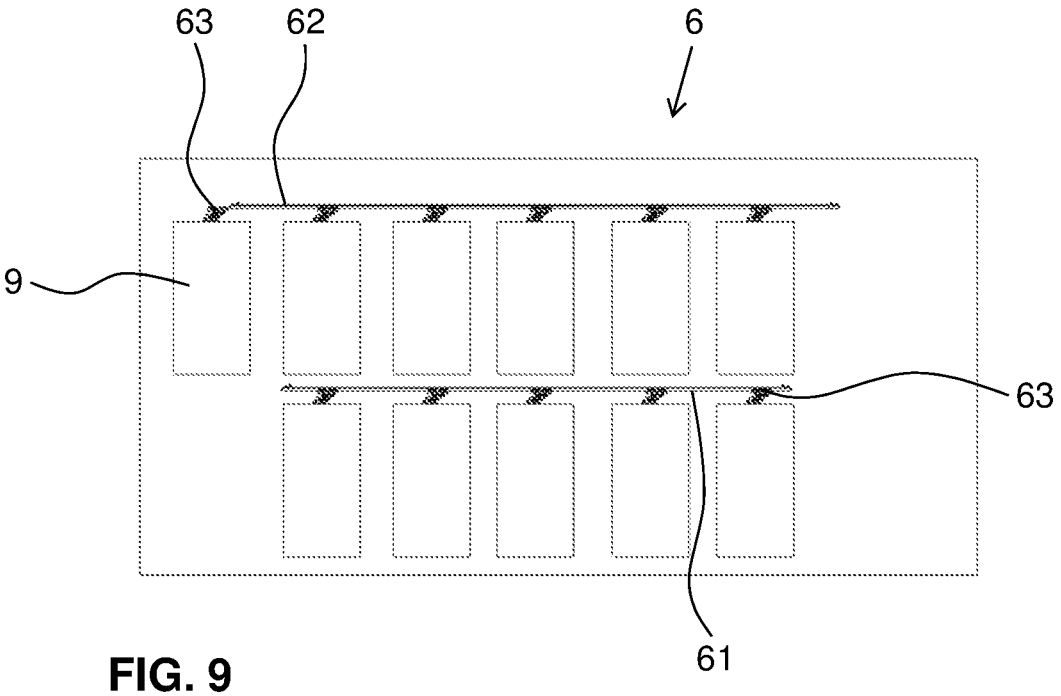
FIG. 9 shows a schematic front view of the charging system of the storage system.

FIG. 9 shows a schematic front view of the charging system 6 of the storage system of FIG. 1. It is the aim of the system to supply electrical current to the individual containers 9, regardless of where the containers 9 are presently situated. The system has current rails 61, 62 which are arranged in the frameworks 100, 101, 102 of the transportation systems such that current collectors 63 arranged on the containers 9 can be placed in contact with the rails 61, 62. The current rails 61, 62 are designed such that the current collector 63 of a container 9 that is situated in one of the vertical transportation units 4, can run out of or run into the corresponding current rail.

Figure 10:
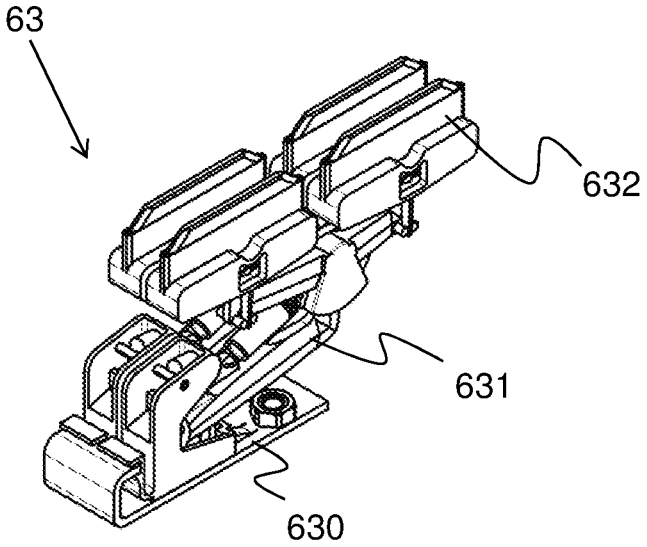
FIG. 10 shows a perspective view of a current collector of the charging system.

FIG. 10 shows a perspective view of a current collector 63 of the charging system 6 of FIG. 6. The current collector 63 has a fastening 630, an arm 631 arranged pivotably on the fastening 630, and a contact 632 arranged pivotably on the arm 631, wherein the contact 632 may have multiple contacts arranged adjacent to one another. The current collector 63 is arranged by way of the fastening 630 on the container 9.

Figure 11:
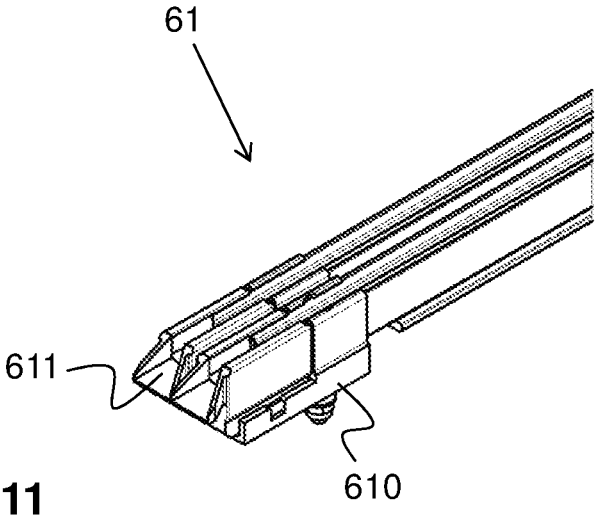
FIG. 11 shows a perspective view of a current rail of the charging system.

FIG. 11 shows a perspective view of a current rail 61 of the charging system 6 of FIG. 6. Each rail 61 has, at least at its free ends, a fastening 610 and a lead-in portion 611. Each rail may have multiple rails arranged parallel to one another. The rail 61 is arranged by way of the fastening 610 on the respective frameworks 100, 101, 102. The lead-in portion 611 facilitates the run-in of the current collector 63.

LIST OF REFERENCE NUMERALS

1 Housing
10 Frame/framework
100 Horizontal framework
101 First vertical framework
102 Second vertical framework
103 Connecting element
104 Connecting element
11 Upper cover
12 Lateral cover
13 Securing element
2 Loading and unloading station
20 Hatch
3 Horizontal transportation unit
30 Drive
31 Shaft
32 Belt/chain
33 Rail
34 Pulley
35 Driver
4 First vertical transportation unit
40 Drive
41 Shaft
42 Belt/chain
43 Rail
44 Belt pulley
5 Second vertical transportation unit
6 Charging system
61 Lower rail
610 Fastening
611 Lead-in portion
62 Upper rail
63 Current collector
630 Fastening
631 Arm
632 Contact
7 Input unit
8 Control unit
9 Container
90 Base
91 Side wall
92 Door
93 Lid
94 Rear wall
95 Terminal
96 Flexible connection
97 Frame
970 First frame element
971 Second frame element
972 First guide roller
973 Second guide roller

The invention claimed is:

1. A storage system for vehicles, in particular two-wheeled vehicles, bicycles or motorcycles, having:

a substantially closed housing with a storage region which is not accessible from the outside and with at least one closable loading and unloading station of the vehicles;

a transportation system for conveying the vehicles from the at least one loading and unloading station into the storage region and within the storage region, wherein the vehicles can be stored and conveyed in mutually separate containers, wherein the system has a charging system, by way of which electrical energy can be supplied to each container.

2. The storage system for vehicles, according to claim 1, wherein each of the containers is of substantially cuboidal shape and is at least partially closed at least by a base and by side walls on three sides.

3. The storage system according to claim 2, wherein each container additionally has a closable door by way of which a further side is at least partially closable, and/or has a lid by way of which a top side is at least partially closable.

4. The storage system according to claim 3, wherein the door and the lid are operatively connected and are movable jointly with one another.

5. The storage system according to claim 2, wherein the transportation system is designed such that the containers can be conveyed in a horizontal or vertical direction.

6. The storage system according to claim 5, wherein the transportation system is divided into units which are responsible for the horizontal conveyance of the containers and units which are responsible for the vertical conveyance of the containers, and wherein the containers are movable independently of one another or jointly with one another.

7. The storage system according to claim 6, wherein the units for the horizontal conveyance of the containers are arranged one above the other, and the units for the vertical conveyance of the containers are arranged adjacent to one another.

8. The storage system according to claim 7, wherein the units for the vertical conveyance of the containers are arranged laterally in each case on an opposite side of the units for the horizontal conveyance of the containers, or wherein the units for the horizontal conveyance of the containers are arranged in each case above or below on an opposite side of the units for the vertical conveyance of the containers.

9. The storage system according to claim 2, wherein at least a multiplicity of the containers is connected by way of the transportation system, and at least the multiplicity of the containers is movable simultaneously with one another.

10. A storage system for vehicles, in particular two-wheeled vehicles, bicycles or motorcycles, having:

a substantially closed housing with a storage region which is not accessible from the outside and with at least one closable loading and unloading station of the vehicles;

a transportation system for conveying the vehicles from the at least one loading and unloading station into the storage region and within the storage region, wherein the vehicles can be stored and conveyed in mutually separate containers, and wherein each container has at least one inwardly oriented electrical terminal to which an electrical device can be connected by a user.

11. The storage system according to claim 10, wherein an electrical accumulator for a vehicle with an electric drive, or a vehicle with an electric drive, can be connected to the inwardly oriented electrical terminal.

12. The storage system according to claim 2, wherein the system furthermore has:

an input unit which allows a user access to the system;

a control unit for controlling and monitoring the system and for optional data communication with an external control unit, wherein the control unit can be actuated by the input unit, and wherein the control unit is responsible in particular for access authorization for the user and for the conveyance of the vehicles.

13. The storage system according to claim 2, wherein the system has at least one securing element by way of which the system can be secured in a usage space, such that unauthorized removal of the system can be prevented.

* * * * *